United States Patent [19]

Chao

[11] Patent Number: 4,949,555

[45] Date of Patent: Aug. 21, 1990

[54] REFRIGERATOR

[76] Inventor: Ching-I Chao, 87, San-Duo 2nd Rd., Kaohsiung, Taiwan

[21] Appl. No.: 346,437

[22] Filed: May 2, 1989

[51] Int. Cl.[5] ..... E25D 17/02

[52] U.S. Cl. ..... 62/374; 62/63; 62/380

[58] Field of Search ..... 62/63, 64, 374, 375, 62/380

[56] References Cited

U.S. PATENT DOCUMENTS 2,080,103 5/1937 Zarotschenzeff ..... 62/375

2,787,141 4/1957 Julius ..... 62/375

*Primary Examiner*—Ronald C. Capossela

*Attorney, Agent, or Firm*—Skjerven, Morrill, MacPherson, Franklin & Friel

[57] ABSTRACT

A cooling device which includes a conveyer belt to carry food products thereinto is provided with improvements in which a spraying device for spraying a cold salt solution onto the belt includes a first and second spraying unit provided above and below the conveyer belt so that a salt solution can be sprayed both directly onto the food products and onto the bottom side of the belt when the food products are covered or packaged, or sprayed onto the bottom side of the belt only when the food products are not covered or packaged. A secondary cooling unit operating with a cooling medium coming from an evaporator of the cooling device includes a tray-like member divided by a heat transfer plate into an upper chamber for receiving the salt solution after being sprayed and a lower chamber for receiving the cooling medium.

4 Claims, 3 Drawing Sheets

REFRIGERATOR

This invention relates to a refrigerator for rapid cooling of food products.

A typical refrigerator for rapidly cooling food products is shown in FIG. 1. It includes an elongated housing A and a conveyer belt B to carry food products through the housing. In the interior of the housing, there are fans C driven by motors D to draw in air, a spraying unit F provided below the belt to spray a cooled salt solution, i.e. NaCl solution onto the bottom side of the belt, an evaporator E to evaporate a cooling medium which cools the air drawn in and the salt solution to be sprayed, and a secondary cooling unit G operating with the cooling medium coming out from the evaporator to cool the salt solution after the solution is sprayed. In operation, the cooling medium which passes through a compressor (not shown) is drawn into the evaporator and then to the cooling unit from where the cooling medium is then sent back to the compressor. The salt solution is first cooled by the evaporator and the cooled salt solution is sprayed onto the bottom side of the conveyer belt, thereby cooling the belt which in turn cools the food products placed thereon. The spray unit so arranged is used for cooling unpackaged food products. However, the effect of cooling the belt with a single spray unit below the belt is inefficient. After being sprayed, the salt solution is sent to the cooling unit which includes shell-and-tube heat exchangers, and is cooled by passing through the interior of the tubes of the heat exchangers. Because the salt solution forms scales on the inner sides of the tubes when passing therethrough, it is verying difficult to clean the tubes and the build up of scales inside the tubes decreases the efficiency of the heat transfer of the cooling unit.

SUMMARY OF THE INVENTION

An object of the invention is to provide a refrigerator of the type described above with an improved heat exchanger for the cooling unit.

Another object of the invention is to provide a refrigerator of the type described above with an improved spray unit so as to increase the effectiveness of the refrigerator.

According to the present invention, a refrigerator of the type described above is provided with improvements in which the spraying means of the refrigerator includes a first and second spraying unit provided above and below the conveyer belt so that a salt solution can be sprayed both directly onto the food products and the bottom side of the belt when the food products are covered or packaged, or sprayed onto the bottom side of the belt only when the food products are not covered or packaged.

A further improvement is embodied in the cooling unit which includes a tray-like member having a partition member which divides the tray-like member into a lower chamber to receive the cooling medium coming from the evaporator and an upper chamber to receive the salt solution after it is sprayed, the tray-like member also having fin plates projecting from the partition plate into the second chamber. The salt solution in the second chamber can be cooled effectively due to the presence of the fin plates.

The present exemplary preferred embodiment will be described in detail with reference to the accompanying drawing.

DETAILED DESCRIPTION OF THE PREFERRED EMBODIMENT

Figure 1:
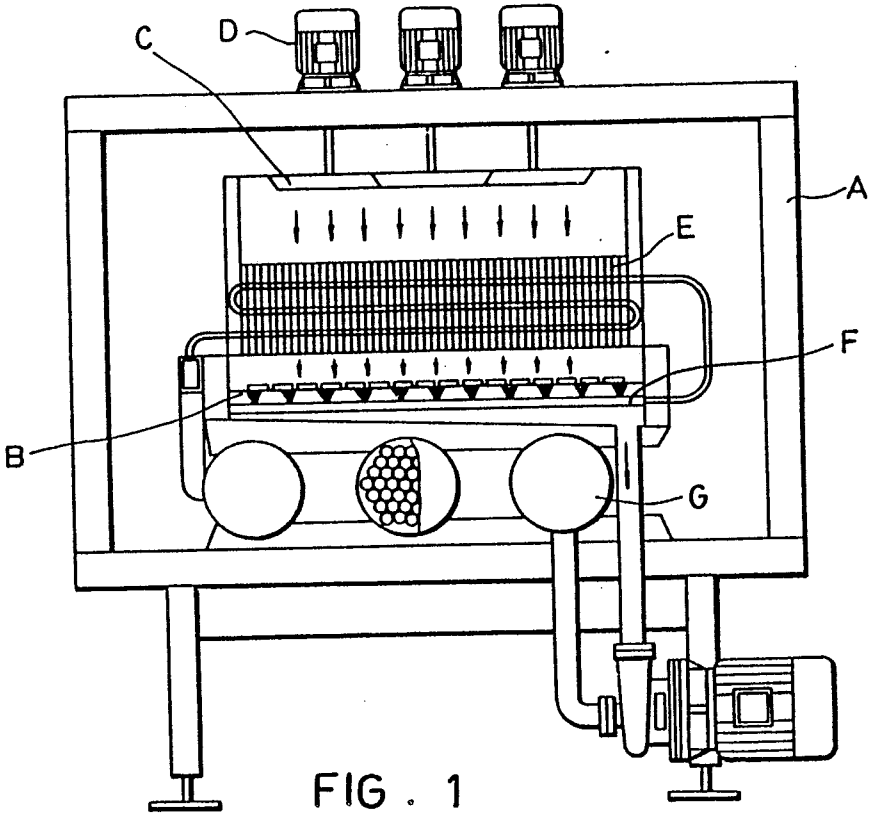
FIG. 1 (PRIOR ART)
FIG. 1 shows a cross-sectional view of a conventional Prior Art refrigerator for the rapid cooling of food products.

Referring to FIGS. 2 to 5, a cooling device according to the present invention includes an elongated housing 1, motors 4 provided at the top of the housing 1, two transmission wheels 3, fans 42 inside the housing 1 operated by the motors 4, evaporators 5, tubes for transporting an aqueous salt solution, and a conveying belt 31 extending through the housing.

Figure 2:
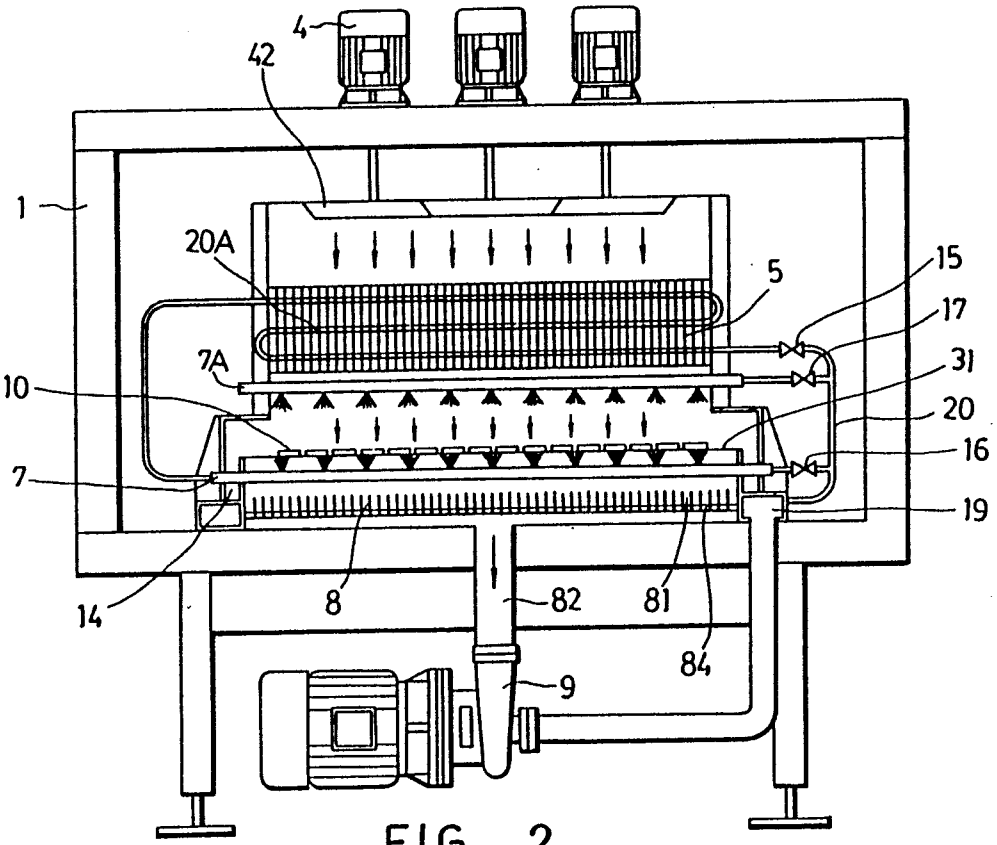
FIG. 2 is a cross-sectional view of a refrigerator according to the present invention.

As shown in FIG. 2, the device also includes a spray tube 7 below the conveyer belts 31. A spray tube 7A is provided above the conveyer belts 31. The spray tubes 7 and 7A are connected to a bent tube 20 and another bent tube 20A which passes through the evaporator 5. Control valves 16, 17 are attached to the tubes 7A and 7, and a control valve 15 is attached to the tube 20 where the tube 20 enters the evaporator 5. By means of the valves 15, 16 and 17, the operation of the pump 9 can be regulated. The evaporator 5 includes passages or conduits for the flow of a cooling medium or a refrigerant coming from a compressor (not shown). The refrigerant from the evaporator 5 is sent to a secondary cooling unit which is described hereinbelow.

Figure 5:
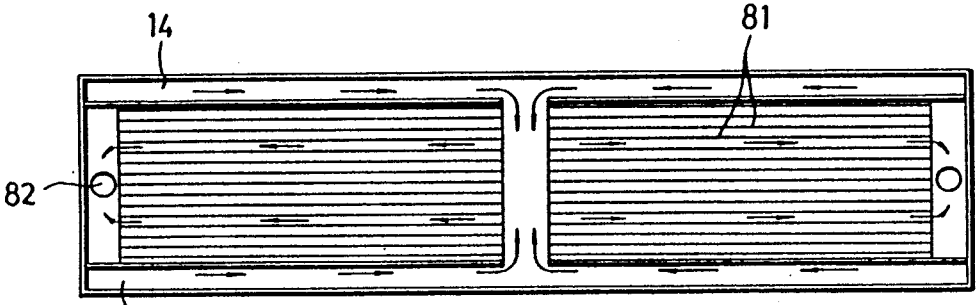
FIG. 5 shows an elevation view of the tray-like member.
Figure 3:
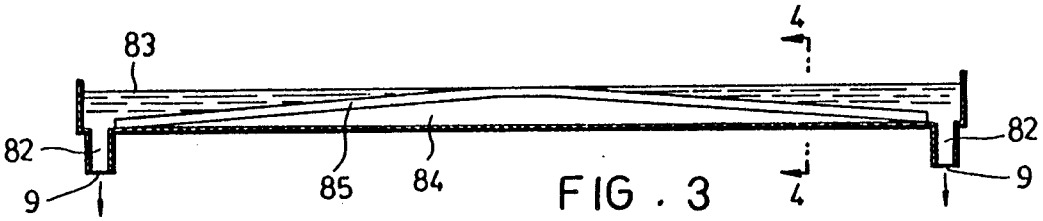
FIG. 3 is a schematic sectional view of the tray-like member of the refrigerator of FIG. 2.
Figure 4:
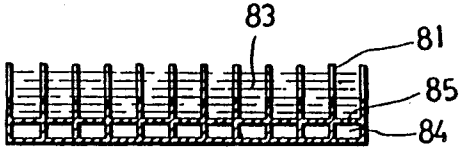
FIG. 4 is a sectional view taken along line 4—4 of FIG. 3.

As shown in FIGS. 3, 4, 5, the secondary cooling unit is provided below the conveyer belt 31 and includes a tray-like member 8 which has a partition plate 85 dividing the member 8 into an upper chamber 83 for receiving the salt solution after sprayed and a lower chamber 84 for receiving the cooling medium. Fin plates 81 project from the partition plate 85 into both the upper and lower chambers 83, 84 to increase the cooling effect. The partition plate 85 of tray-like member 8 is slanted downward from the central portion thereof to the lateral portion of the tray-like member 8. The lower chamber 84 receives the cooling medium coming from the evaporator which will absorb heat from the salt solution and is connected to the compressor (not shown) described above to complete a recycling path for the cooling medium.

Referring again to FIG. 2 in combination with FIGS. 3, 4 and 5, the salt solution sprayed onto the belt 31 can be discharged into two troughs 14 provided on two sides of the belt 31 and then flows downward into the chamber 83. The salt solution in the chamber 83 first flows to the lateral portion of the chamber 83 and then to conduits 82 which are connected to a pump 9.

The operation of the device will be described hereinafter. If the food product to be cooled is not packaged, the valve 15 is opened and the valves 16 and 17 are closed. The salt solution is pumped into the flexible tube 20 through the pump 9 and a delivery tube 19 and then sent to the spray tube 7, being passed through the evaporator 5. Afterwards, the salt solution is sprayed onto the bottom side of the heat conductive conveyer belt 31 on which food products 10 are placed.

In addition to the cooling effect provided by the conveyer belt 31, the food product is further cooled by means of cooling air which is drawn into the housing 1 by the fans 42, and is cooled by passing through the evaporator 5. The salt solution delivered from the spray tube 7 falls on the tray-like member 8 and then flows to the conduit 82 after being cooled. The cooled salt solution is then pumped into the evaporator 5.

If the food product is already packaged, the valves 16, 17 are opened and the other valve 15 is closed. The cooling salt solution can be sprayed from the tube 7 below the conveyer belt and the other tube 7A which spray the cooling solution directly onto the packages of the product. The spraying solution from the tubes 7 and 7A is discharged to passages 14 and then to the conduits 82 after the spraying operation. In this operation, the fans 42 do not operate. This method can also be used for cooling the food product 10 which is not packaged but is covered by a protective film.

With the invention thus explained, it is apparent that various modifications and variations can be made without departing from the scope of the invention. It is therefore intended that the invention be limited only as indicated in the appended claims.

What I claim is:

1. A device for cooling objects comprising:

a housing having a first end and a second end;

a conveyor for carrying objects to be cooled from said first end to said second end;

a spray means to spray a salt solution from a salt solution source onto said conveyor;

a cooling unit disposed in said housing operating with a cooling medium in a closed passage, to cool the salt solution in an open passage collecting the salt solution after it has been sprayed and providing it to said source.

2. A cooling device as claimed in claim 1, wherein said closed passage and open passage of said cooling unit is further comprised of:

a tray-like member having a partition which divides said tray-like member into a lower chamber which receives said cooling medium and an upper open chamber which receives said salt solution after it has been sprayed, said tray-like member further having fin plates projecting from said partition plate into said upper open chamber.

3. A cooling device as claimed in claim 2, wherein said partition is slanted downward from a first portion of said tray-like member to a second portion of said tray-like member, wherein the salt-solution received on said tray-like member flows to said second portion of said tray-like member and is connected from said second portion to said salt solution source.

4. A cooling device as claimed in claim 3, wherein said first portion of said tray-like member is located at a central portion of said tray-like member and said second portion is located at a lateral portion of said tray-like member.

* * * * *